US006325874B1

(12) United States Patent
Wheeler, Jr.

(10) Patent No.: US 6,325,874 B1
(45) **Date of Patent: *Dec. 4, 2001**

(54) COLD FORMING FLAT-ROLLED HIGH-STRENGTH STEEL BLANKS INTO STRUCTURAL MEMBERS

(75) Inventor: Robert P. Wheeler, Jr., Dayton, OH (US)

(73) Assignee: Consolidated Metal Products, Inc., Cincinnatio, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/454,459

(22) Filed: Dec. 3, 1999

(51) Int. Cl.[7] ..... C21D 7/02
(52) U.S. Cl. ..... 148/650; 148/603
(58) Field of Search ..... 148/650, 603

(56) References Cited

U.S. PATENT DOCUMENTS

| | | | |
|---|---|---|---|
| 1,862,281 | 6/1932 | Schaefer . | |
| 2,767,836 | 10/1956 | Nachtman et al. | 207/10 |
| 2,767,837 | 10/1956 | Nachtman et al. | 207/10 |
| 2,880,855 | 4/1959 | Nachtman | 205/21 |
| 2,953,794 | 9/1960 | Klooz | 10/27 |
| 3,001,897 | 9/1961 | Nachtman | 148/12 |
| 3,066,408 | 12/1962 | Fader | 29/552 |
| 3,076,361 | 2/1963 | Epstein et al. | 30/60 |
| 3,557,587 | 1/1971 | Cardillo | 72/41 |
| 3,573,999 | 4/1971 | Gokyo | 148/12 |
| 3,720,087 | 3/1973 | Gottschlich | 72/364 |
| 3,877,281 | 4/1975 | Shimizu et al. | 72/364 |
| 3,883,371 | 5/1975 | Geary . | |
| 3,904,445 | 9/1975 | Gallagher | 148/12 |
| 3,908,431 | 9/1975 | Jones et al. | 72/364 |
| 4,289,548 | 9/1981 | Bucher et al. | 149/12 |
| 4,312,210 | 1/1982 | Nishizawa et al. | 72/267 |
| 4,317,355 | 3/1982 | Hatsuno et al. | 72/342 |
| 4,608,851 | 9/1986 | Khare | 72/364 |
| 4,805,437 | 2/1989 | Heil et al. | 72/356 |
| 5,330,594 | 7/1994 | Gallagher, Jr. . | |
| 5,496,425 | 3/1996 | Gallagher, Jr. . | |

FOREIGN PATENT DOCUMENTS

| | | |
|---|---|---|
| 3434743A1 | 4/1986 | (DE) . |
| 0 093 218 | 11/1983 | (EP) . |
| 2218399 | 9/1974 | (FR) . |
| 1535775 | 12/1978 | (GB) . |
| 51-144328A | 12/1976 | (JP) . |
| 58027958 | 2/1983 | (JP) . |

OTHER PUBLICATIONS

Anthony J. DeArdo, *A New Cost–Effective Steel for High Strength Cold Forming Operations*, circa 1993.
Saarstahl, *Wire and Wire Rods Hardened and Tempered In Coils*, Apr. 1981.
C. W. Wegst, Stahlschlüssel, Verlagstahlschlüssel Wegst GMBH, D–7142 Marbach, 1989.
M. L. Bernstein and N. V. Filatova, *Strengthening of Warm–Rolled Low–Carbon Steels*, 1984 Plenum Publishing Corporation.
Carl A. Keyser, *Materials Science in Engineering*, Second Edition, 1974.

(List continued on next page.)

*Primary Examiner*—Deborah Yee
(74) *Attorney, Agent, or Firm*—Wood, Herron and Evans, L.L.P.

(57) ABSTRACT

A method of making high-strength steel structural members is disclosed by providing a flat-rolled blank of high-strength steel having a ferrite-pearlite microstructure and high-strength mechanical properties and cold forming the blank by rolling or the like to provide a structural member having a desired geometric cross-section while the mechanical strength of the structural member remains substantially the same or greater than the flat-rolled blank.

20 Claims, 3 Drawing Sheets

OTHER PUBLICATIONS

Isao Gokyu and Teruo Kishi, *Warm Working of Steel*, 1968 vol. 9, Supplement.

Kobe Steel, *High–Tensile Bolts*, Chemical Abstracts No. 101411b, vol. 95, No. 12, Sep. 21, 1981, p. 219.

E. Nehl, *Warm Extrusion of Free–Cutting*, CA102(22): 888 63K American Chem. Society, 1984.

Lankford W.T. Jr., Samways N.L., Craven R.F., McGannon H.E., *Making, Shaping and Treating of steel*, 10, US, Pittsburgh, Ass. Iron and Steel Engineers, 1985.

TechTrends, *Innovative Technologies Key to Truck–Frame Build*, Forming & Fabricating, Feb. 1999.

C.I. Garcia, A.K. Lis and A.J. DeArdo, A new microalloyed multi–phase steel for high strength cold heading applications, Proceedings of the 60th Annual Convention and 1990 Division Meetings of The Wire Association Intarnational, Inc.

A.J. DeArdo, Accelerated Cooling: A Physical Metallurgy Perspective, Canadian Metallurgical Quarterly, vol. 27, No. 2, 1988, pp. 141–154.

R. G. Davies, The Deformation Behavior of a Vanadium–Strengthened Dual Phase Steel, Metallurgical Transactions, vol. 9A, Jan. 1978, pp. 41–52.

COLD FORMING FLAT-ROLLED HIGH-STRENGTH STEEL BLANKS INTO STRUCTURAL MEMBERS

FIELD OF THE INVENTION

This invention relates to a method of making high-strength steel structural members, and more particularly, it relates to a method in which a flat-rolled blank of high-strength steel is cold formed into a structural member having a desired geometric cross-section, such that the strength of the member remains substantially the same or greater than the blank.

BACKGROUND OF THE INVENTION

A number of methods have heretofore been used to make steel parts and structural members. These methods often begin with bars of high-strength material and employ cold forming techniques, such as rolling, upsetting, heading and extrusion, which are well known in the art. In upsetting, the cross-sectional area of a portion or all of a bar of metal is increased. Heading is a particular form of upsetting where the starting material is wire, rod or bar stock. The heads of bolts are often made using heading techniques. In extrusion, the metal bar is forced through a die orifice of a desired cross-sectional outline to produce a length of metal having a uniform cross section. Extrusion is particularly applicable for forming elongate structural members having a uniform cross-sectional configuration over substantially the entire length of the member. Rolling includes forming a finished member by repeatedly passing rollers over the length of the bar until it is formed into the desired shape.

One such method for making high-strength steel structural members which is well known begins by annealing or otherwise softening the steel bar. The annealed steel bar is then cold formed, in a process which includes one of the above described forming techniques, into a desired geometric cross-section. The now formed structural member is then heat treated, i.e., austenitized, hardened by quenching followed by tempering, to obtain the high-strength mechanical properties desired. The steel material of the resulting member typically has a tempered martensite microstructure. The mechanical properties produced from such heat treatments are often inconsistent and can vary widely from member to member. In addition, the annealing and heat treating steps significantly add to the cost of the overall process for making the high-strength steel structural members, due in large part to the energy consumption associated with heating the member and the required labor and processing.

In another method for making such high-strength steel structural members, the steel is initially austenitized, hardened by quenching and then tempered to the point where the mechanical properties of the post-heat treated bar are such that it can be subsequently cold formed, in a process which includes one of the above described forming techniques, into a desired geometric cross-section. The steel material of the finished member from this method also has a tempered martensite microstructure. While this method apparently has advantages over the previously described method in that narrower strength tolerances from member to member have reportedly been obtained, this method still employs a costly heat treating process.

Cold forming high-strength material is known. In U.S. Pat. No. 3,904,445, hereby incorporated by reference in its entirety, which issued to the present assignee, a method is disclosed for cold forming a length of high-strength steel bar stock into a U-bolt. However, cold forming a bend in a length of bar stock is less severe than other cold forming techniques, such as upsetting and extruding. Until the invention of the '445 patent, it was thought that cold forming a blank of high-strength into a part or structural member by upsetting or extrusion type techniques would likely result in the formation of cracks or even fractures in the finished product or at the least would likely require the gradual formation of the member by a series of cold forming steps with an annealing or stress relieving step performed between successive cold forming operations. Such cracks or fractures would likely ruin the member. In addition, employing such cold forming and annealing steps would add to the time and cost of making such high strength steel structural members.

One newer method for cold forming high-strength steel structural members is disclosed in U.S. Pat. No. 5,496,425, hereby incorporated by reference in its entirety, which issued to the present assignee. In the practice of the invention described in the '425 patent, high-strength steel material having a specific chemical composition is cold formed into a structural member for forging or extruding the high-strength steel material through a tapered die is required as in typical forging and extrusion processes. While such a process avoids many of the disadvantages and drawbacks described hereinabove and associated with warm or hot forming of structural members, it does require the application of significant forces and pressures associated with the extrusion process. Specifically, forcing high-strength steel material in a cold drawing process through a tapered die or the like to form a structural member requires a significant amount of pressure or energy to be exerted on the steel material, the die and associated machinery. As such, forging and extrusion processes for cold forming structural members require a significant amount of energy and may result in damage to the forging or extrusion equipment as well as frequent replacement of the dies or associated components.

A die suitable for cold drawing or forging process is very costly and therefore a significant and potentially expensive item for repair and replacement. Therefore, the opportunity to avoid cold drawing or extrusion offers significant advantages in the commercial production of high-strength steel structural members. Additionally, the capacity for heat-treating structural members to increase or improve the mechanical properties is limited. Therefore, the requirement for such heat treatment should, if at all possible, be avoided while still providing high-strength steel structural members with the appropriate strength levels.

SUMMARY OF THE INVENTION

There has heretofore been lacking a method of making a high-strength steel structural member having a ferrite-pearlite microstructure and possessing desired high-strength properties, which method avoids extrusion or forging and includes a cold forming step whereby the blank is flat-rolled material and is cold formed into a desired structural member, with the mechanical strength of the member remaining substantially the same or greater strength than that originally possessed by the flat-rolled blank without the need of heat treatment.

The term "blank" as used herein has its usual meaning, i.e., a piece of metal to be formed into a finished member of desired geometric cross-section. This invention is particulary directed to flat-rolled blanks in which the blank is derived from a coil of high-strength steel material, sheet, plate or generally planar stock material. A flat-rolled blank is differentiated from a structural member in that a structural member has at least one flange included in its cross-sectional configuration. The flange has a thickness less than an overall outer dimension of the cross-sectional configuration of the structural member and provides increased load bearing capability to the structural member.

The present invention is directed to a method of making high-strength steel structural members from flat-rolled blanks of high-strength steel material. In one embodiment, the flat-rolled blank has a ferrite-pearlite microstructure and a tensile strength of at least about 120,000 psi and a yield strength of at least about 90,000 psi with the following composition by weight percent: carbon—about 0.30 to about 0.65%, manganese—about 0.30 to about 2.5%, at least one microalloying additive from the group consisting of aluminum, niobium (i.e., columbium), titanium and vanadium and mixtures thereof, in an amount up to about 0.35%, and iron—balance.

In one of its aspects, the present invention provides a method of making high-strength steel structural members from such flat-rolled blanks by cold forming the flat-rolled blank by rolling to provide a member having the desired geometric cross-section with a ferrite-pearlite microstructure, whereby the mechanical properties of tensile strength and yield strength of the member are substantially the same or greater than the flat-rolled blank. The finished structural members may have a variety of configurations and applications. For example, a pair of C-shaped structural members may be used as side rails on a truck chassis or the like.

The present invention also provides a method of making high-strength steel structural members which includes cold forming a flat-rolled blank of high-strength steel whereby the mechanical properties of tensile strength and yield strength are substantially the same or greater than the flat-rolled blank and wherein the member, with the desired mechanical properties of tensile strength and yield strength, are produced without the need for further processing steps to improve toughness. Depending at least in part on its geometric cross-section, some members may need to be stress relieved within a temperature range of between about 450° F. to about 1,200° F. in order to raise, lower, or otherwise modify the mechanical properties of the steel member (e.g., tensile strength, yield strength, percent elongation, hardness, percent reduction of area, etc.).

In one embodiment of this invention, the flat-rolled blank is in the form of a coil of high-strength steel material whose thickness has been reduced by rolling or extrusion. This coil is initially slit or cut to provide coil sections of a specified width. Subsequently, the flat-rolled blank is cut to a specified length. The flat-rolled blank is then cold formed by rolling or other appropriate techniques at a temperature of between ambient and up to less than about 300° F. (150° C.). More preferably the structural member is not heat treated after the cold forming step to avoid the time and expense associated with such a step as well as the other previously discussed drawbacks of heat treatment techniques. Shot peening the structural member to increase fatigue life and forming holes as appropriate for the structural member may be advantageous.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 2:
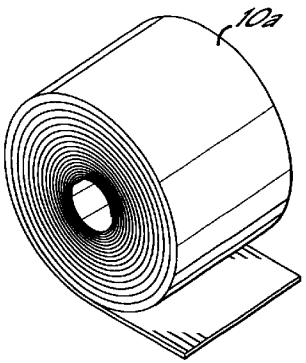
FIG. 2 is a perspective view of a coil section cut to width from the coil of FIG. 1.

The method of the present invention is useful for producing a wide variety of finished high-strength steel structural members from flat-rolled blanks. In particular, elongated high strength steel structural members which have a uniform cross-sectional configuration over substantially their entire length. For example, structural members having an O, L, C, Z, I, T, W, U, V shapes and other members which are susceptible to forming by the cold forming process are described herein. Structural members having a C-shaped cross-sectional configuration which were produced according to this invention are particularly suited for use as side rails or the like on a truck chassis.

A flat-rolled blank is distinguished herein from a structural member in that a structural member is elongate with a uniform cross-sectional configuration which includes at least one flange. The flange is a member which has a thickness less than an overall outer dimension of the cross-sectional configuration (i.e., the width, height, or outer diameter of the structural member). The flange distinguishes the structural member from a flat-rolled blank in that the flange provides increased load bearing capability to the member. In other words, the structural member has more load bearing capability with the flange than a member without the flange having the same material composition and properties as the structural member. The load may be axial as in an end-on load, lateral as in a side load or any other type of load applied to the structural member. The flange is integrally formed either continuously or discontinuously with respect to the remainder of the structural member. Examples of discontinuous flanges are the upper and lower portions of an I-shaped beam with respect to the center portion of the I-beam, or of either leg of an L-shaped truss with respect to the other leg of the truss. An example of a continuous flange is any cord or portion of the cross-sectional configuration of an O-shaped structural member. Examples of structural members having at least one flange are O, L, C, Z, I, T, U, V, and W shaped members.

In one embodiment, the method of the present invention for making a high-strength steel structural member includes providing a flat-rolled blank of high-strength steel material having a microstructure of fine pearlite in a ferritic matrix, a tensile strength of at least about 120,000 psi and preferably at least about 150,000 psi, and a yield strength of at least about 90,000 psi, and preferably at least about 130,000 psi. Pearlitic constituents are generally considered to be "fine" when their lamellae are not resolvable at an optical magnification of about 1000×. In one form, the high-strength steel material utilized as the flat-rolled blank has been previously hot reduced and cold rolled to provide the mechanical properties of tensile strength and yield strength stated above.

The high-strength steel material used to make the flat-rolled blank has the following composition, by weight percent:

carbon about 0.30 to about 0.65% manganese about 0.30 to about 2.5% at least 1 microalloying element from the group consisting of aluminum, niobium, titanium and vanadium, and mixtures thereof, in an amount up to about 0.35% iron balance.

In a more preferred form, the high-strength steel material has the following composition, by weight percent:

carbon about 0.40 to about 0.55% manganese about 0.30 to about 2.5% at least 1 microalloying element from the group consisting of aluminum, niobium, titanium and vanadium, and mixtures thereof, in an amount up to about 0.20% iron balance.

In a still more preferred form, the high-strength steel material has the following composition, by weight percent:

carbon about 0.50 to about 0.55% manganese about 1.20 to about 1.65% at least 1 microalloying element from the group consisting of aluminum, niobium, titanium and vanadium, and mixtures thereof, in an amount from about 0.03 to about 0.20% iron balance.

While aluminum, niobium (i.e., columbium), titanium and vanadium may be known as grain refiners, in this invention these components are not used to produce a steel with fine grains as in typical grain refining applications. These elements are used in this invention as microalloying components to increase and/or maintain the strength levels of the resulting cold formed structural member. Furthermore, it should be understood that the compositions listed and claimed herein may include other elements which do not impact upon the practice of this invention.

The flat-rolled blank, having a composition and mechanical properties of tensile strength and yield strength as given above is thereafter cold formed using techniques as rolling or the like at a temperature between ambient or room temperature up to less than about 300° F. (150° C.), and preferably at about ambient temperature, to provide a member having a desired geometric cross-section, whereby the mechanical properties of tensile strength and yield strength of the member are substantially the same or greater than the flat-rolled blank. The formed member, with the mechanical properties of tensile strength and yield strength given, is preferably produced without the need for further processing steps, such as a final stress relieving step, to improve toughness. However, for certain geometric cross-sections and applications of the member, a stress relieving step may be necessary.

The flat-rolled blank of high-strength steel material having a tensile strength of at least about 120,000 psi and a yield strength of at least 90,000, which is used as the starting piece in the method of the present invention, is produced by any suitable method known in the art. One such method is disclosed in U.S. Pat. No. 3,904,445 to the present assignee and the specification in its entirety is incorporated herein by reference.

Figure 1:
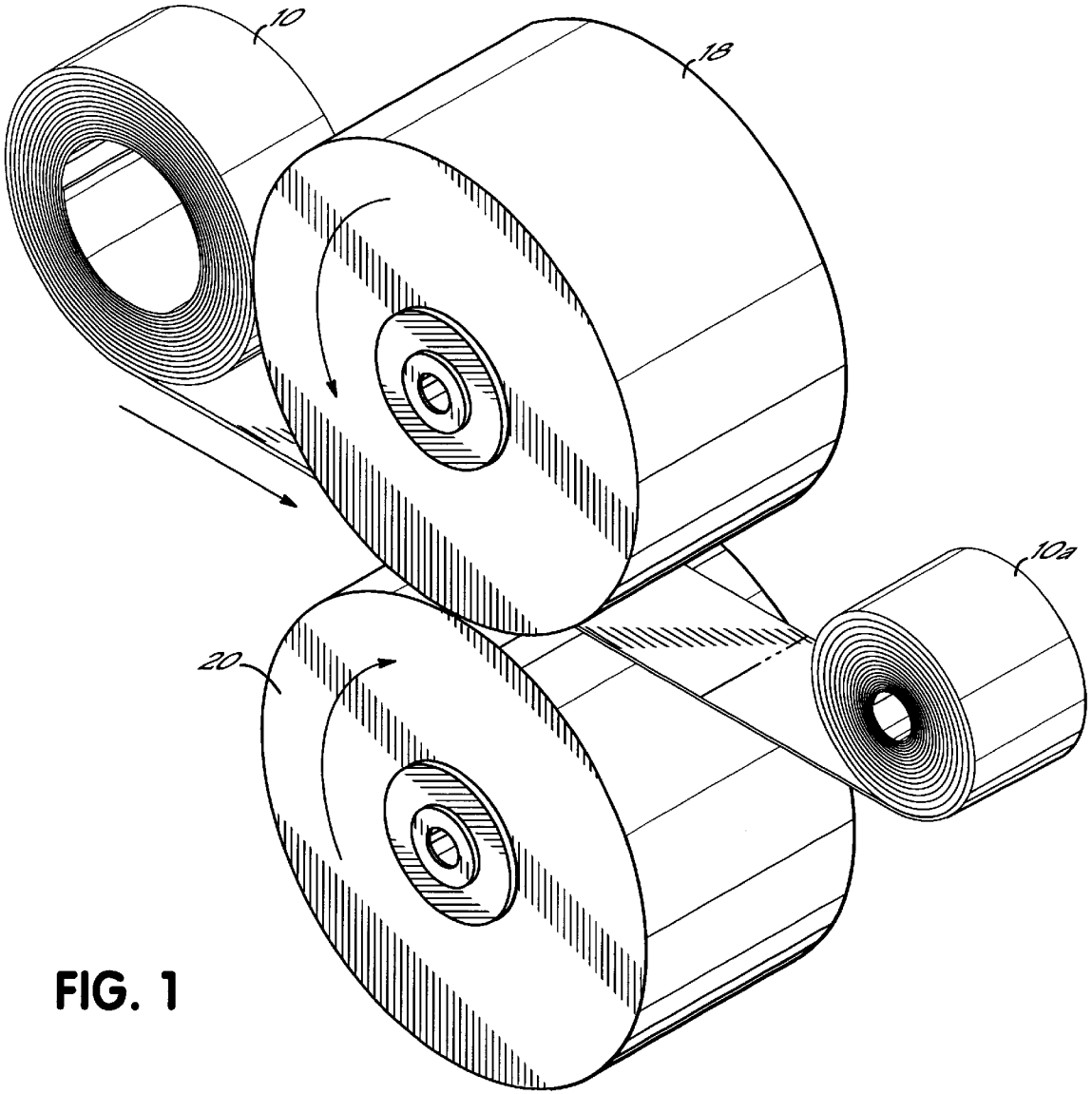
FIG. 1 is a schematic representation of a thickness reduction step for a coil of high strength steel material for use as the starting material in making structural members according to one embodiment of this invention.
Figures 3, 4:
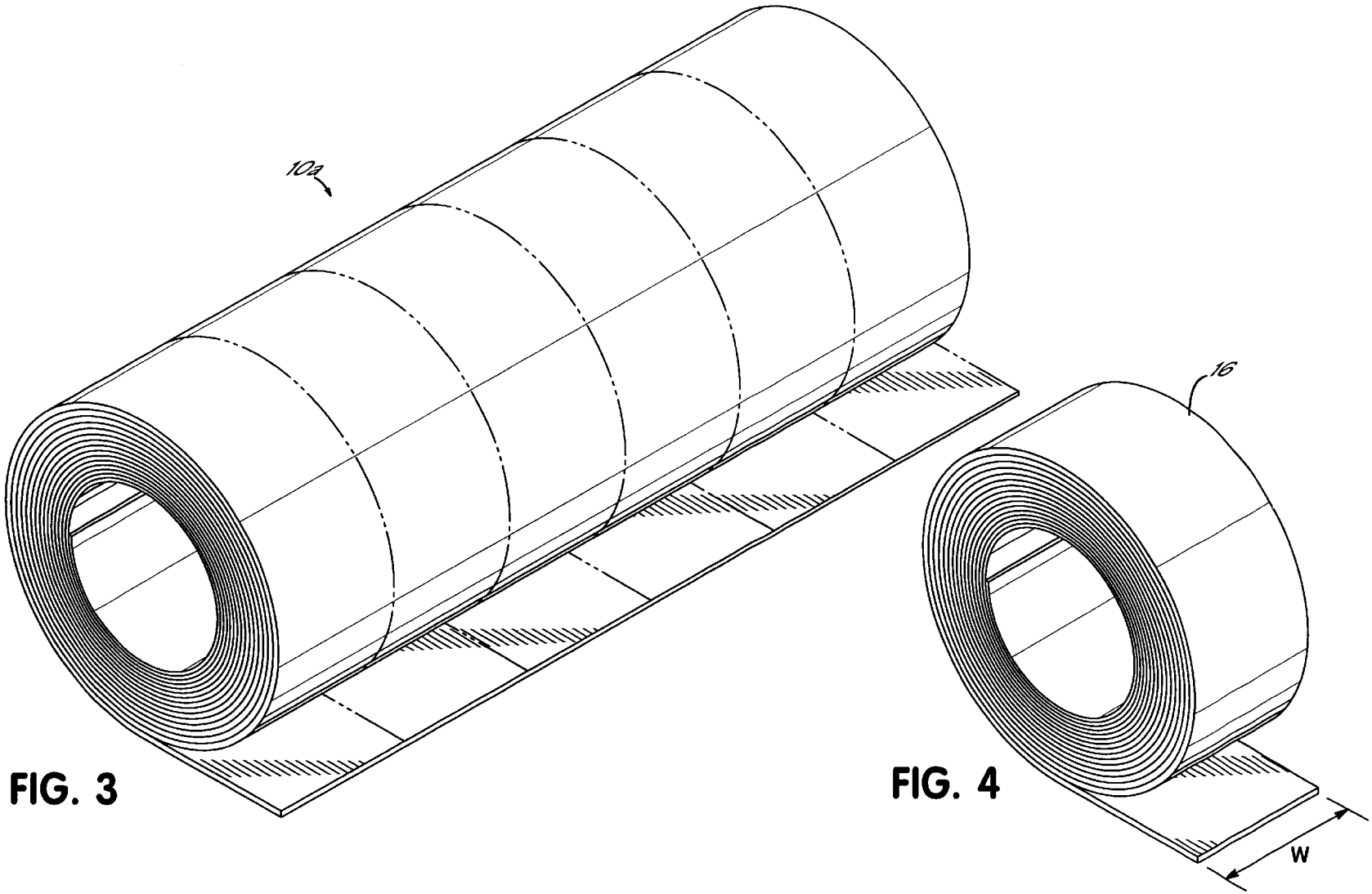
FIG. 3 is a perspective view of the high strength steel material used to produce a flat-rolled blank.
FIG. 4 is a perspective view of the coil section resulting from the thickness reduction step of FIG. 1.
Figure 5:
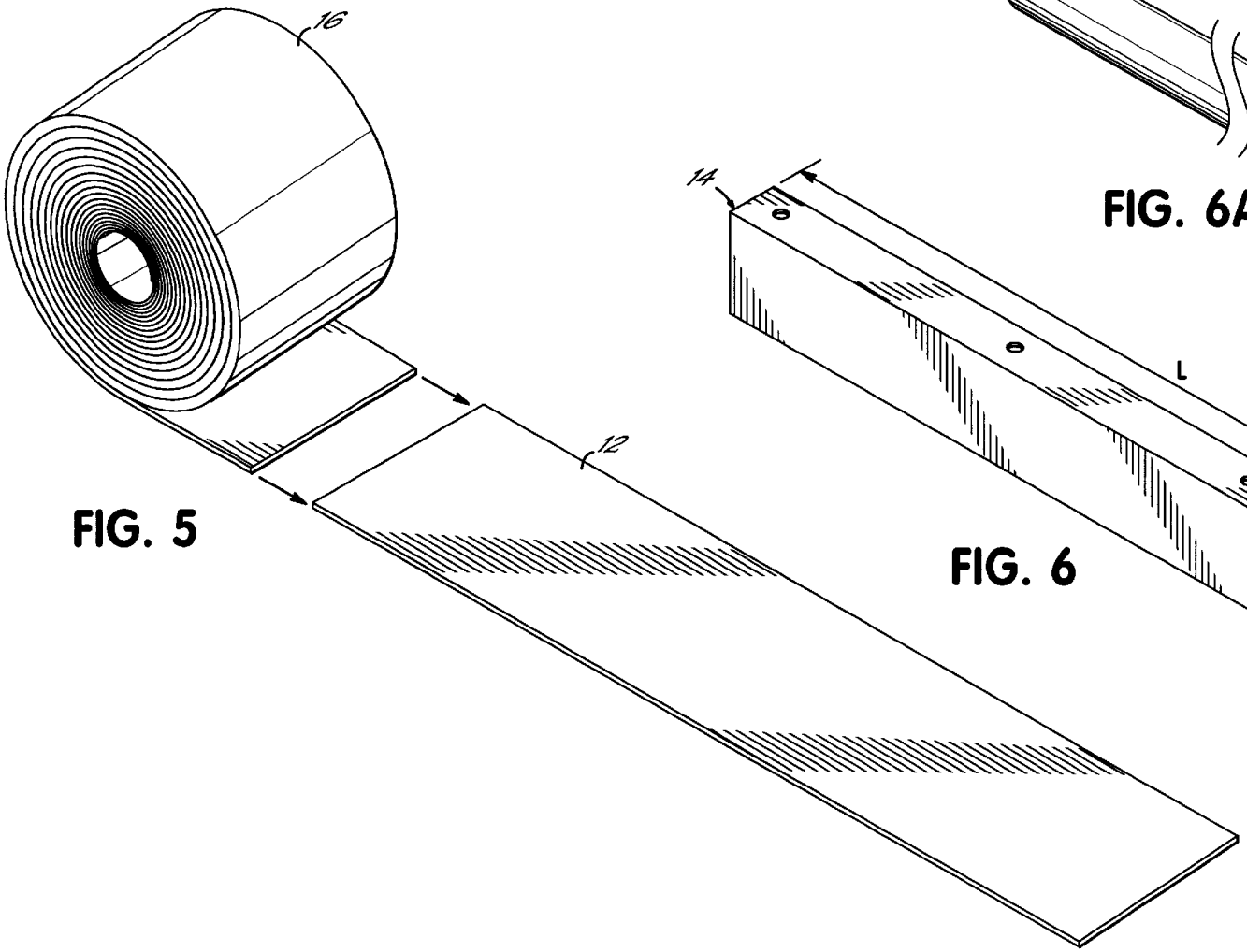
FIG. 5 is a schematic representation of a flat-rolled blank cut to length from the coil section.

Referring to FIG. 3, a coil 10*a* of high-strength steel material is shown which, in one embodiment of this invention, is utilized to produce the flat-rolled blank 12 for forming the high-strength steel member 14. The steel of the coil 10*a* has the above-described chemical composition as well as tensile and yield strength levels. The coil 10*a,* according to one form of this invention, has been previously hot-rolled, cold reduced and subsequently slit or cut to provide coil sections 16 having a specified width W of approximately 16 inches (FIG. 4). Next, during the cold reducing the coil sections 10 are processed between counter-rotating rollers 18, 20 or the like for cold reduction as shown in FIG. 1. The resulting reduced coil section 10*a,* as shown in FIG. 1, is then slit to the desired width W to produce coil sections 16, FIG. 4. The coil section 16 is then unrolled and cut to length, as shown in FIG. 5, to provide the flat-rolled blank 12.

Alternatively, although the flat-rolled blank 12 is shown and described in one embodiment as originating from the coil 16 of high-strength steel material, the flat-rolled blank 12 may also be provided in other forms such as sheet, plate or other planar members and the like, all of which are collectively referred to herein as flat-rolled blanks.

Figure 6A:
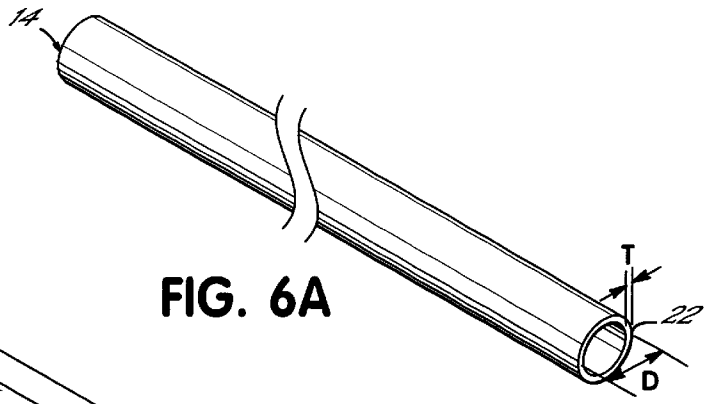
FIGS. 6 and 6A are perspective views of representative structural members produced from cold forming the flat-rolled blank.
Figure 6:
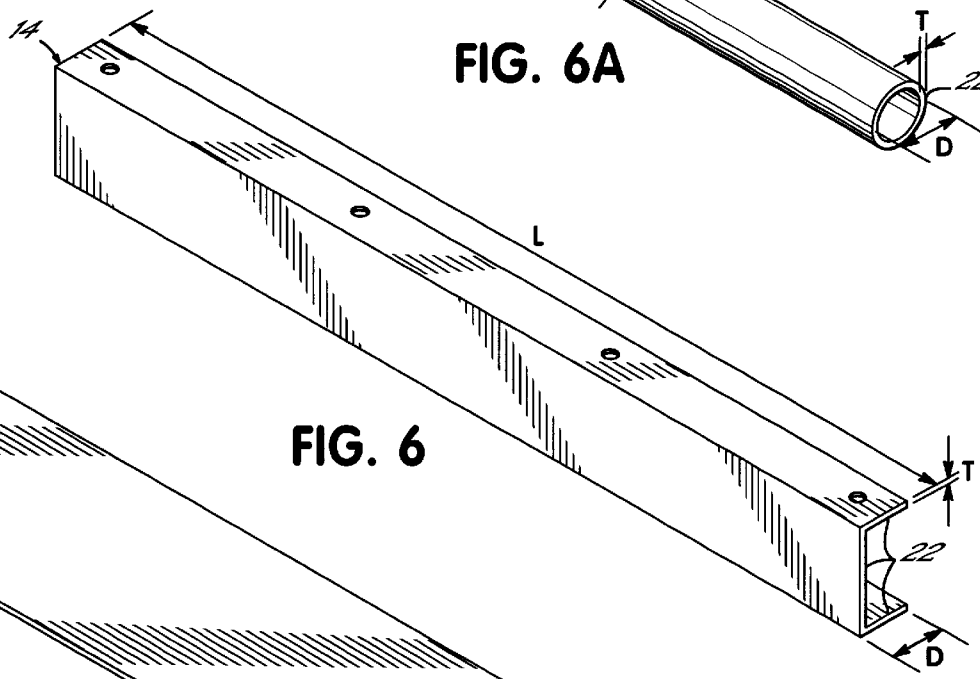

The flat-rolled blank 12 is then cold formed preferably at ambient temperature and up to about 300° F. (150° C.) by rolling or other appropriate cold forming methods to produce a structural member 14, examples of which are shown in FIGS. 6 and 6A. Preferably, the cold forming process used for the high-strength steel structural member 14 is by rolling or bending through the use of a brake press. The cold formed structural member 14 is an elongate member of length L which, in one embodiment, has a uniform cross-sectional configuration which includes at least one flange 22 having a thickness T which is less than an overall outer perimeter dimension D of the cross-sectional configuration such that the flange 22 provides increased load-bearing capacity to the structural member 14. For example, as shown in FIG. 6A, a structural member 14 having a cross-sectional configuration of an O-shape has a flange 22 with a thickness T identified by the thickness of the sidewall of the O-shaped structural member 14. The thickness T is less than the overall outer perimeter dimension D of the O-shaped structural member.

Similarly, a C-shaped structural member 14, as shown in FIG. 6, includes an upper flange 22 and a lower flange 22 joined together by an intermediate flange 22 in which at least one of the flanges has a thickness T which is less than at least one overall outer perimeter dimension D.

After the high-strength steel member 14 is cold formed, shot peening of the structural member may be used to increase the fatigue life thereof. An example of a typical shot peening process which may be used with this invention includes a 100% coverage area of the structural member (SAE J443 January 1984) in which a shot specification of MI-230-H (SAE J444 May 1993) with an intensity of 0.016 to 0.018A (SAE J442 January 1995) was used.

One significant benefit of this invention over known processes for forming high-strength steel structural members includes the cold thickness reduction step for the flat-rolled blank which work-hardens or strain-hardens the steel to maintain and/or increase the mechanical properties thereof. Additionally, since the high-strength steel structural member is preferably roll-formed, subsequent heat treatment, straightening and rework of the formed structural member is not required as in prior processes often utilized for side rails of a truck chassis.

The following example illustrates the practice of this invention to produce a structural member from a high-strength steel flat-rolled blank in accordance with this invention.

EXAMPLE

High-strength steel 6150 alloy had the following composition by weight:

| | |
|---|---|
| Carbon | 0.50% |
| Manganese | 0.83% |
| Phosphorous | 0.009% |
| Sulphur | 0.009% |
| Silicon | 0.25% |
| Chromium | 0.90% |
| Nickel | 0.05% |
| Molybdenum | 0.02% |
| Vanadium | 0.20% |
| Iron | Balance. |

A flat-rolled blank of the above-identified chemical composition was produced from flat sheet having a thickness of 0.230 inches, a width of 10.75 inches and a length of 13 inches which was H.R. annealed and cold-rolled.

The flat-rolled blank as described was then cold-rolled into a C-shaped high-strength steel member having a configuration of ¼ inch×2 inch×2 inch×4 inch×4 inch. The high-strength structural member was then tested at two locations in each of the longitudinal and transverse directions. The longitudinal test resulted in an ultimate tensile strength of 119,000 psi and 118,000 psi at each location and a yield strength at 0.2% offset of 108,000 psi and 109,000 psi. The transverse specimen direction tests indicated an ultimate tensile strength of 118,000 psi at each location, a yield strength at 0.2% offset of 92,000 psi and 100,000 psi. The above-described strength levels were the same as those of the flat-rolled blank. The tensile testing was performed in accordance with ASTM-E8-98. The corner or radius joining the flanges of the C-shaped structural member shown in FIG. 6 were also tested at two locations and resulted in an ultimate tensile strength of 123,000 psi and 122,000 psi. The yield strength at 0.2% offset was tested at 101,000 psi and 108,000 psi at the respective test locations.

The microstructure of the high-strength steel member was evaluated in accordance with ASTM-E3-95 and a cross section of the member was mounted, polished and etched with Nital/Picral to reveal the microstructure. Examination at 100–1,000× magnification revealed a structure of pearlite and ferrite with randomly distributed fine carbines. An inclusion content examination per ASTM-E45-87 was also performed under method A (worst field rating) in which a sample was mounted and polished to a 1.0 micron finish and evaluated at 100× magnification. This examination resulted in a type A inclusion of 2½ thin and of 1 heavy and a type D inclusion of 2 thin and of 1½ heavy. Type B and type C inclusions were not identified in the specimen.

The mechanical properties of tensile strength and yield strength of the finished C-shaped structural member are greater or at least the same as those than that originally possessed by the flat-rolled blank, and therefore, no further strengthening processing steps are required. The finished member also has enough of the desired mechanical property of ductility originally possessed by the steel material that the need for further processing steps to improve strength can generally be eliminated. However, for certain uses of the structural member, a shot peening or stress relieving step may be necessary.

Compared to prior methods which use a heat treating process (i.e., austenitizing, hardening by quenching and tempering), especially when the heat treatment was used after cold forming to produce the desired high-strength mechanical properties of the member, finished structural members made according to the present invention are more likely to consistently have mechanical properties which fall within a narrower range. Thus, the present invention is more likely to consistently produce structural members with higher strength levels and within a narrower range.

The scope of the present invention is not intended to be limited by the example provided herein, but rather as defined by the appended claims.

What is claimed is:

1. A method of making a high-strength steel structural member having a specific uniform cross-sectional configuration comprising the steps of:

providing a blank of flat-rolled high-strength steel material having a tensile strength of at least about 118,000 psi and a yield strength of at least about 90,000 psi; and cold forming the flat-rolled blank into a structural member having a uniform cross-sectional configuration along substantially its entire length;

whereby the mechanical properties of tensile and yield strength of the structural member are substantially the same as or greater than the blank without the need for further processing steps to improve toughness.

2. The method of claim 1 wherein the flat-rolled blank has a ferrite pearlite microstructure and further comprises by weight:

carbon about 0.30 to about 0.65% manganese about 0.30 to about 2.5% at least one microalloying additive from the group consisting of aluminum, niobium, titanium, vanadium and mixtures thereof up to about 0.35% iron balance.

3. The method of claim 1 further comprising:

cutting the flat-rolled blank to a specified width prior to the cold forming.

4. The method of claim 1 further comprising:

reducing a thickness of the flat-rolled blank prior to the cold forming.

5. The method of claim 1 further comprising:

cutting the flat-rolled blank to a specified length.

6. The method of claim 1 wherein the flat-rolled blank originates from a coil.

7. The method of claim 1 wherein the cold forming is performed at a temperature between ambient and up to less than about 300° F. (150° C.).

8. The method of claim 1 wherein the structural member is not heat treated after the cold forming.

9. The method of claim 1 wherein the flat-rolled blank has previously been hot rolled.

10. The method of claim 6 further comprising:

decoiling the coil of high-strength steel blank material into a generally planar configuration prior to the cold forming.

11. The method of claim 4 wherein the reducing is to about 10% to about 15% of the thickness of the flat-rolled blank.

12. The method of claim 1 further comprising:

shot peening the structural member to increase fatigue life thereof.

13. The method of claim 1 further comprising:

forming holes in at least one of the flat-rolled blank and the cold formed structural member.

14. The method of claim 1 wherein the cold forming further comprises cold rolling.

15. The method of claim 1 wherein the cross-sectional configuration further comprises at least one flange having a thickness less than an overall outer perimeter dimension of the cross-sectional configuration and the flange provides increased load bearing capacity to the structural member.

16. The method of claim 15 wherein the cross-sectional configuration is selected from the group consisting of O, L, C, Z, I, T, U, V, and W shapes.

17. The method of claim 2 wherein the high-strength steel material comprises by weight percent:

carbon about 0.40 to about 0.55% manganese about 0.30 to about 2.5% at least one microalloying additive from the group consisting of aluminum, niobium, titanium, vanadium and mixtures thereof up to about 0.20% iron balance.

18. The method of claim 1 wherein the flat-rolled blank of high-strength steel material has a tensile strength of at least about 150,000 psi and a yield strength of at least about 130,000 psi.

19. The method of claim 17 wherein the high-strength steel material comprises by weight percent:

carbon about 0.50 to about 0.55% manganese about 1.20 to about 1.65% at least one microalloying additive from the group consisting of aluminum, niobium, titanium, vanadium and mixtures thereof from about 0.3 to about 0.20% iron balance.

20. A method of making a high-strength steel structural member having a specific uniform cross-sectional configuration comprising the steps of:

providing a blank of flat-rolled high strength-steel material in the form of a coil having a ferrite pearlite microstructure and a tensile strength of at least about 118,000 psi and a yield strength of at least about 90,000 psi that comprises by weight:

carbon about 0.30 to about 0.65% manganese about 0.30 to about 2.5% at least one microalloying additive from the group consisting of aluminum, niobium, titanium, vanadium and mixtures thereof up to about 0.35% iron balance;

reducing a thickness of the flat-rolled coil blank; and cold forming the flat-rolled coil blank into a structural member having a uniform cross-sectional configuration along substantially its entire length at a temperature between ambient and up to less than about 300° F. (150° C.), the cross-sectional configuration of the structural member having at least one flange with a thickness less than an overall outer perimeter dimension of the cross-sectional configuration, the flange providing increased load bearing capacity to the structural member;

whereby the mechanical properties of tensile and yield strength of the structural member are substantially the same as or greater than the blank without the need for further processing steps to improve strength.

* * * * *